US009725938B2

(12) United States Patent
Murata

(10) Patent No.: US 9,725,938 B2
(45) Date of Patent: Aug. 8, 2017

(54) LUGGAGE DOOR HINGE

(71) Applicant: TOYOTA JIDOSHA KABUSHIKI KAISHA, Toyota-shi, Aichi-ken (JP)

(72) Inventor: Masaya Murata, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/148,725

(22) Filed: May 6, 2016

(65) Prior Publication Data

US 2016/0348412 A1 Dec. 1, 2016

(30) Foreign Application Priority Data

May 27, 2015 (JP) ..... 2015-107367

(51) Int. Cl.
*E05D 5/06* (2006.01)
*E05F 1/12* (2006.01)

(52) U.S. Cl.
CPC ..... *E05D 5/062* (2013.01); *E05D 5/06* (2013.01); *E05D 2005/067* (2013.01); *E05F 1/1246* (2013.01); *E05Y 2900/546* (2013.01); *E05Y 2900/548* (2013.01); *Y10T 16/5389* (2015.01)

(58) Field of Classification Search
CPC ..... Y10T 16/5389; Y10T 16/533; Y10T 16/53834; Y10T 16/558; E05D 5/062; E05D 11/0054; E05D 2005/067; E05D 5/06; E05Y 2900/548; E05Y 2900/546; E05F 1/1246; B62D 25/087
USPC ..... 16/308, 250, 289, 387; 296/76, 193.08, 296/56
See application file for complete search history.

(56) References Cited

U.S. PATENT DOCUMENTS 4,776,626 A * 10/1988 Seyler ..... E05D 5/062 16/289
5,195,796 A 3/1993 Wampler, II
7,314,243 B2 1/2008 Okada et al.
(Continued)

FOREIGN PATENT DOCUMENTS

DE 3426287 A1 1/1986
DE 102006010186 B3 6/2007
(Continued)

OTHER PUBLICATIONS

Oct. 24, 2016 Search Report issued in European Patent Application No. 16169478.1.
(Continued)

*Primary Examiner* — William Miller
(74) *Attorney, Agent, or Firm* — Oliff PLC

(57) ABSTRACT

A luggage door hinge includes: a front side attachment section configured to be rotatably supported by a vehicle body; a rear side attachment section that extends along a vehicle body front-rear direction in a closed state of a luggage door that opens and closes a luggage room, and is configured to be fixed to the luggage door; a curved section that curves in a substantially circular arc shape between the front side attachment section and the rear side attachment section, toward a vehicle body lower side in the closed state of the luggage door; and a coupling member that couples together an intermediate portion of the curved section and the rear side attachment section.

15 Claims, 6 Drawing Sheets

(56) References Cited

U.S. PATENT DOCUMENTS

| | | | | |
|---|---|---|---|---|
| 7,987,554 | B2 * | 8/2011 | Hakamata | E05D 5/062 16/250 |
| 2013/0119698 | A1 | 5/2013 | Patzer et al. | |
| 2015/0211274 | A1 * | 7/2015 | Tanabe | E05D 11/0054 16/250 |

FOREIGN PATENT DOCUMENTS

| | | | | |
|---|---|---|---|---|
| JP | S59-075870 | U | | 5/1984 |
| JP | S62-024693 | Y2 | | 6/1987 |
| JP | 03115681 | A | * | 5/1991 |
| JP | H08-072751 | A | | 3/1996 |
| JP | 2007290604 | A | * | 11/2007 |

OTHER PUBLICATIONS

Apr. 28, 2017 Office Action issued in Chinese Patent Application No. 201610320187.2.

Jun. 20, 2017 Office Action issued in Japanese Patent Application No. 2015-107367.

* cited by examiner

LUGGAGE DOOR HINGE

CROSS-REFERENCE TO RELATED APPLICATION

This application is based on and claims priority under 35 USC 119 from Japanese Patent Application No. 2015-107367 filed on May 27, 2015, the entire disclosure of which is incorporated by reference herein.

BACKGROUND

Technical Field

The disclosure relates to a luggage door hinge.

Related Art

Conventional luggage door hinges are known in which a reinforcing member is added to a curved section of a luggage door hinge that attaches a luggage door to a vehicle body, the rigidity of the curved section is improved, and the resonance frequency of the luggage door is changed in the higher frequency direction, such that noise occurring due to the resonance of the luggage door is suppressed (see, for example, Japanese Patent Application Laid-Open (JP-A) No. 2007-290604).

So-called automatic vehicles equipped with an automatic transmission include a lock-up function that improves running performance and fuel efficiency performance by directly coupling input and output shafts. However, there is a detrimental effect in that, in a low revolution range of the engine during lock-up, the resonance frequency of the engine and the resonance frequency of the luggage door match each other, and an increase in noise (vehicle interior noise) occurs. It is therefore desirable to change the resonance frequency of the luggage door in the lower frequency direction to suppress the noise occurring during lock-up.

It is sufficient to enlarge the shape of the curved section of the luggage door hinge to reduce the rigidity in order to lower the resonance frequency of the luggage door. However, there is a detrimental effect when the shape of the curved section of the luggage door hinge is enlarged and the rigidity is reduced, in that the fitting rigidity of the luggage door is reduced (that is, the fitting performance, which is the rigidity with which the luggage compartment door is held closed, is reduced). Another detrimental effect when the shape of the curved section of the luggage door hinge is enlarged is that the capacity of a luggage room (luggage compartment) is reduced.

SUMMARY

Thus, an object of the embodiments is to provide a luggage door hinge that is capable of lowering the resonance frequency of a luggage door, while suppressing a reduction in the fitting performance of the luggage door.

In order to achieve the above object, a luggage door hinge of a first aspect includes: a front side attachment section that is configured to be rotatably supported by a vehicle body; a rear side attachment section that extends along a vehicle body front-rear direction in a closed state of a luggage door that opens and closes a luggage room, and that is configured to be fixed to the luggage door; a curved section that curves in a substantially circular arc shape between the front side attachment section and the rear side attachment section, toward a vehicle body lower side in the closed state of the luggage door; and a coupling member that couples together an intermediate portion of the curved section and the rear side attachment section.

In the first aspect, the intermediate portion of the curved section of the luggage door hinge and the rear side attachment section are coupled together by the coupling member. The rigidity of the rear side attachment section of the luggage door hinge is thereby improved, and, even though the shape of the curved section of the luggage door hinge is enlarged and the rigidity is reduced, a reduction in the fitting rigidity (fitting performance) of the luggage door is suppressed. Namely, the resonance frequency of the luggage door is lowered, while suppressing a reduction in the fitting rigidity (fitting performance) of the luggage door.

A luggage door hinge of a second aspect includes the luggage door hinge of the first aspect, wherein a beveled portion that forms a horizontal face in the closed state of the luggage door is formed to at least an upper portion side of the front side attachment section.

In the second aspect, the beveled portion that forms a horizontal face in the closed state of the luggage door is formed to at least the upper portion side of the front side attachment section of the luggage door hinge. Thus, even though the shape of the curved section of the luggage door hinge is enlarged, the height thereof is suppressed from becoming higher. A reduction in the capacity of the luggage room is thereby suppressed. Note that the "horizontal face" also includes a "substantially horizontal face" that is not strictly horizontal.

A luggage door hinge of a third aspect includes the luggage door hinge of the first aspect or the second aspect, wherein the coupling member includes an upright panel and a lateral panel that are orthogonal to each other so that the coupling member has an "L" shaped cross-section profile.

In the third aspect, the coupling member includes the upright panel and the lateral panel that are orthogonal to each other, and is configured with an "L" shaped cross-section profile. The rigidity of the coupling member is thereby improved, and the rigidity of the rear side attachment section of the luggage door hinge is more effectively improved. Thus a reduction in the fitting rigidity of the luggage door is more effectively suppressed.

The first aspect enables the resonance frequency of the luggage door to be lowered, while suppressing a reduction in the fitting rigidity (fitting performance) of the luggage door.

The second aspect enables a reduction in the capacity of the luggage room to be suppressed.

The third aspect enables a reduction in the fitting rigidity (fitting performance) of the luggage door to be more effectively suppressed.

BRIEF DESCRIPTION OF THE DRAWINGS

Exemplary embodiments will be described in detail based on the following figures, wherein.

DETAILED DESCRIPTION

Figure 1:
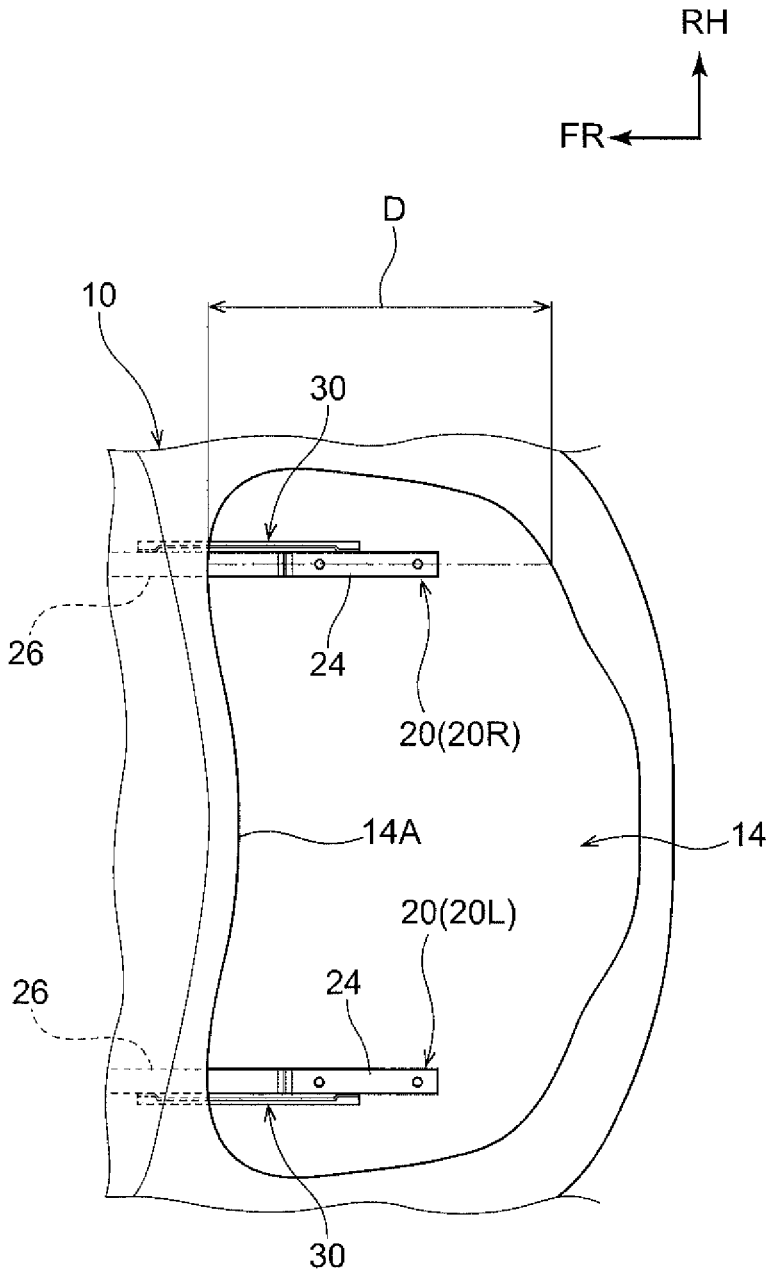
FIG. 1 is a plan view illustrating a luggage room of a vehicle including luggage door hinges according to an exemplary embodiment, with a luggage door omitted.

Detailed explanation follows regarding an exemplary embodiment, based on the drawings. Note that, for ease of explanation in each of the drawings, the arrow UP indicates the vehicle body upper direction, the arrow FR indicates the vehicle body front direction, and the arrow RH indicates the vehicle body right direction, as appropriate. In the below explanation, unless specifically stated otherwise, reference to the front-rear, up-down, and left-right directions refers to front-rear in the vehicle body front-rear direction, up-down in the vehicle body up-down direction, and left-right in the vehicle body left-right direction (vehicle width direction).

In the below explanation, a luggage door hinge 20 at the right side is sometimes referred to with the reference numeral "20R", and a luggage door hinge 20 at the left side is sometimes referred to with the reference numeral "20L". In a closed state of a luggage door 12, a portion of a curved section 26 of each luggage door hinge 20 that is further to the vehicle body rear side than a lowermost point 26B (see FIG. 6) is sometimes referred to as a "rear side intermediate portion", and a portion that is further to the vehicle body front side is sometimes referred to as a "front side intermediate portion".

Figure 2:
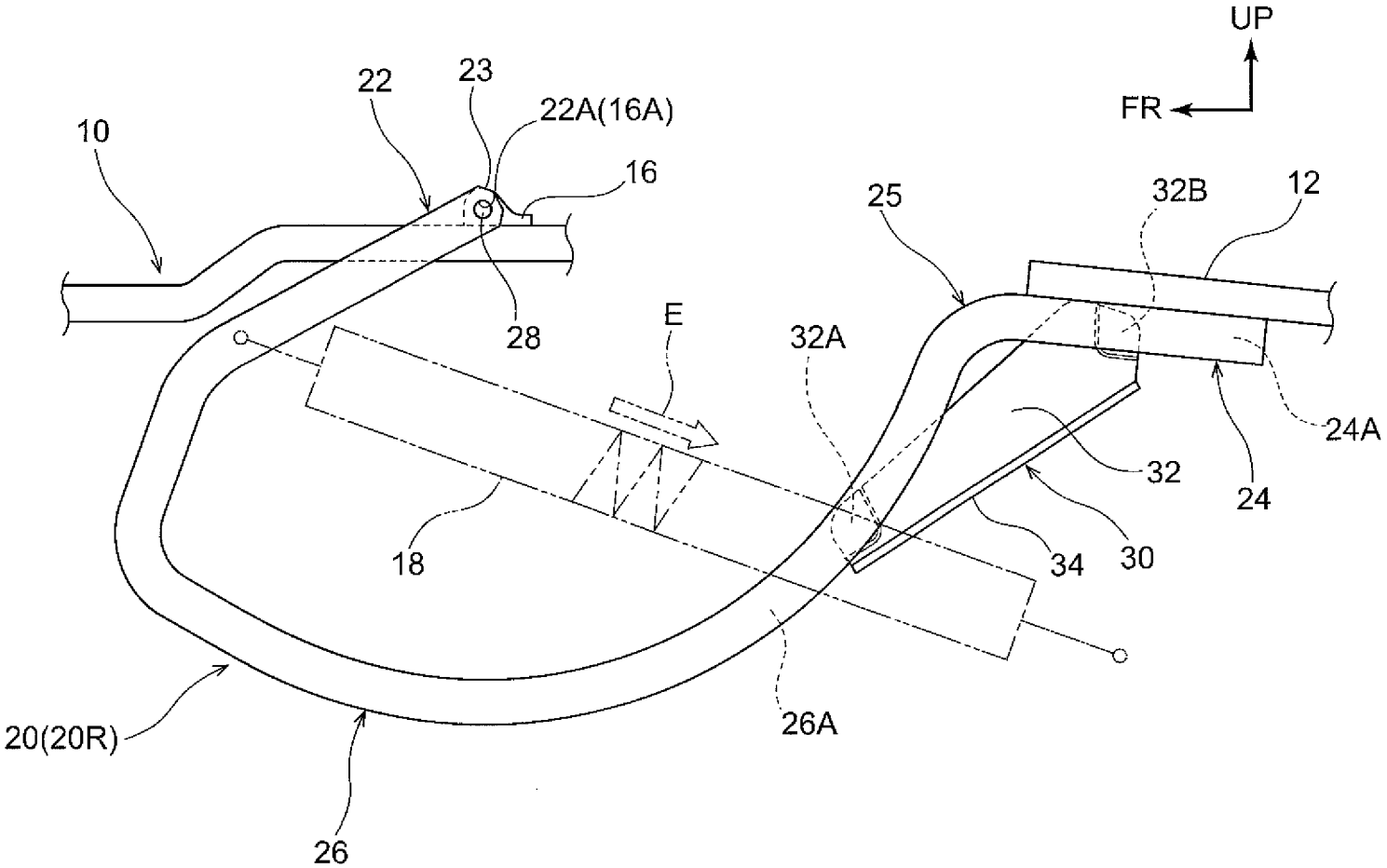
FIG. 2 is a side view illustrating a right side luggage door hinge according to the exemplary embodiment.
Figure 3:
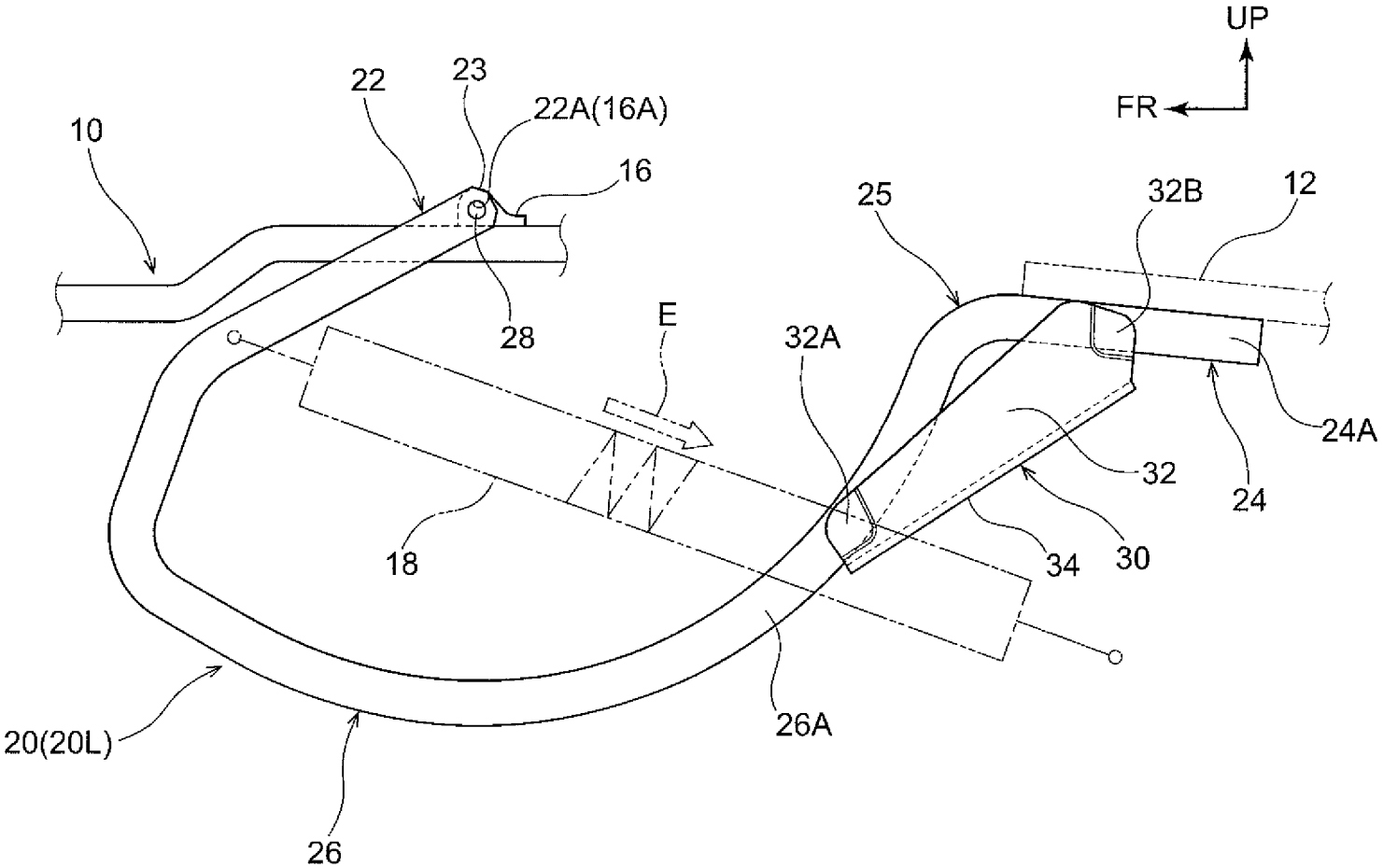
FIG. 3 is a side view illustrating a left side luggage door hinge according to the exemplary embodiment.

As illustrated in FIG. 1 to FIG. 3, the luggage door hinge 20 according to the present exemplary embodiment includes a front side attachment section 22 that is rotatably supported by a vehicle body 10, a rear side attachment section 24 that is fixed to the luggage door 12 that opens and closes a luggage room 14 of the vehicle body 10, the curved section 26 that curves in a substantially circular arc shape between the front side attachment section 22 and the rear side attachment section 24, and a coupling member 30 that couples between the rear side intermediate portion of the curved section 26 and the rear side attachment section 24.

To explain in detail, the luggage door hinge 20 is formed in a hook shape overall, by bending an angular pipe with a rectangular shaped cross-section (see FIG. 4) in a substantially U-shape. The front side attachment section 22 of the luggage door hinge 20 is formed with a through-hole 22A with its axial direction along the vehicle width direction. A bracket 16 including a through-hole 16A that is in communication with the through-hole 22A is provided to the vehicle body 10.

Configuration of the luggage door hinge 20 is thereby such that the rear side attachment section 24 is capable of pivoting in the vehicle body up-down direction with respect to the vehicle body 10 about the front side attachment section 22 (support shaft 28) by placing the through-hole 22A and the through-hole 16A in communication with each other, and inserting through and attaching a support shaft 28 to the through-holes 22A, 16A.

Figure 5:
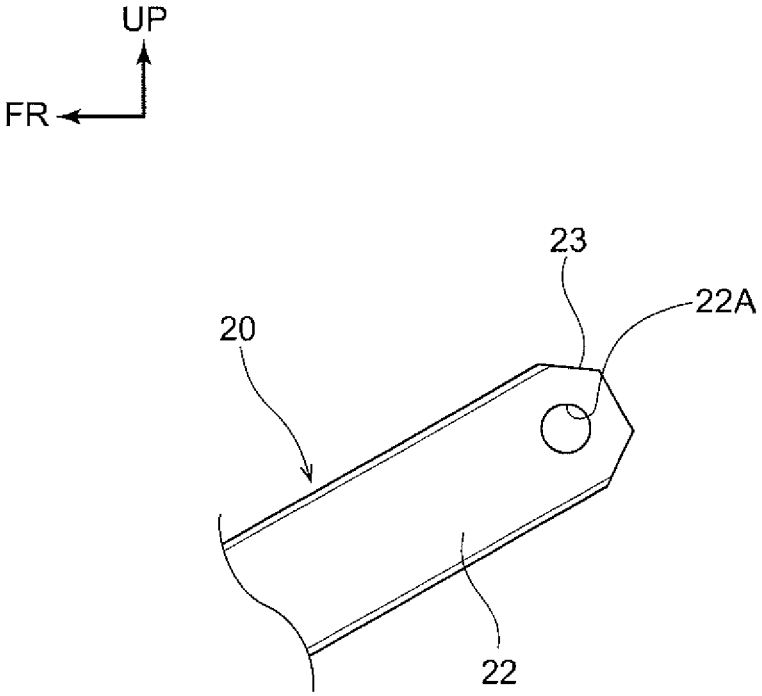
FIG. 5 is an enlarged side view illustrating a front side attachment section of a luggage door hinge according to the exemplary embodiment.

As illustrated in FIG. 5, an upper portion side of the front side attachment section 22 of the luggage door hinge 20 is beveled. Namely, the upper portion side of the front side attachment section 22 of the luggage door hinge 20 is formed with a beveled portion 23 that has a substantially horizontal face in side view of the closed state of the luggage door 12.

In the luggage door hinge 20 according to the present exemplary embodiment, a lower portion side of the front side attachment section 22 also is beveled; however, the lower portion side does not contribute to a height H of the luggage door hinge 20 (see FIG. 6), and so does not necessarily need to be beveled. Namely, it is sufficient that the beveled portion 23 is formed at least on the upper portion side of the front side attachment section 22 that contributes to the height H of the luggage door hinge 20.

As illustrated in FIG. 2 and FIG. 3, the rear side attachment section 24 of the luggage door hinge 20 is configured so as to extend substantially along the vehicle body front-rear direction in the closed state of the luggage door 12. Through-holes 24B, 24C (see FIG. 4), each with its axial direction extending along the vehicle body up-down direction, are formed in the rear side attachment section 24, with an interval in the vehicle body front-rear direction therebetween.

Configuration is thereby such that bolts (not illustrated in the drawings) are inserted into the respective through-holes 24B, 24C, the bolts are screwed together with respective weld nuts (not illustrated in the drawings) provided on the luggage door 12, and the rear side attachment section 24 of the luggage door hinge 20 is accordingly fastened and fixed to the luggage door 12.

The curved section 26 of the luggage door hinge 20 is configured so as to curve in a substantially circular arc shape toward substantially the vehicle body lower side (the vehicle body lower front side in side view) in the closed state of the luggage door 12. Configuration is thereby such that the luggage door hinge 20 does not impinge on (strike) an open edge portion 14A of the luggage room 14 (see FIG. 1) of the vehicle body 10 when opening and closing the luggage door 12.

Figure 4:
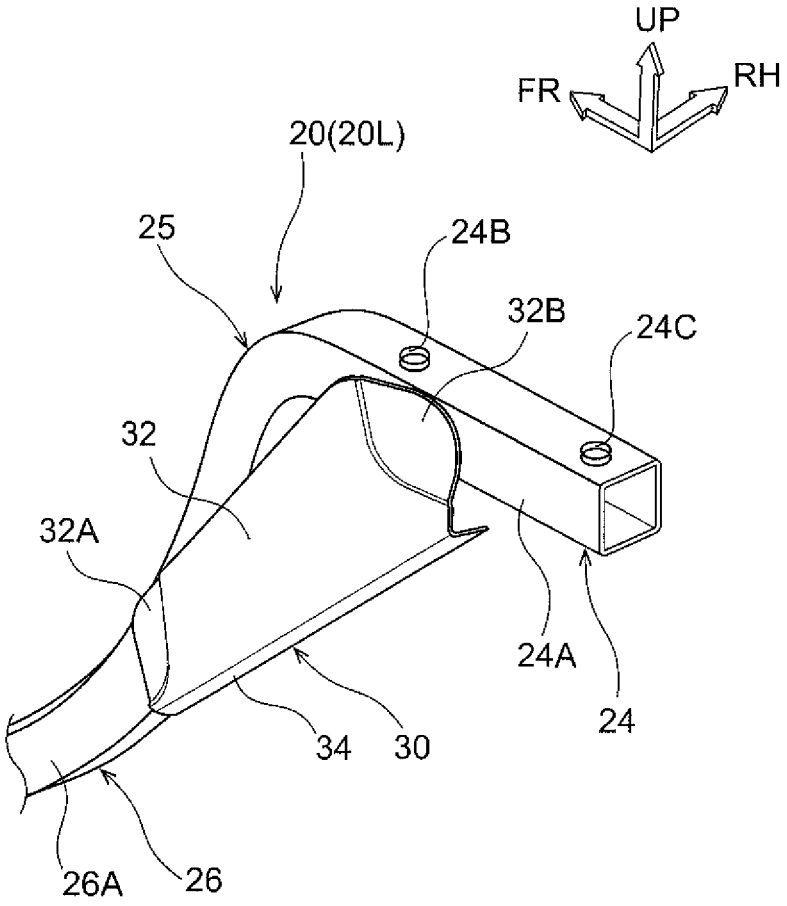
FIG. 4 is an enlarged perspective view illustrating a rear side attachment section of a left side luggage door hinge according to the exemplary embodiment.

As illustrated in FIG. 2 to FIG. 4, the coupling member 30 includes an upright panel 32 and a lateral panel 34 that are orthogonal to each other, and is configured with an "L" shaped cross-section profile. The upright panel 32 is disposed along a direction normal to the vehicle width direction, and the lateral panel 34 is integrally formed thereto by bending a vehicle body lower side end portion of the upright panel 32 at a right angle toward the vehicle width direction inside. The lateral panel 34 is thereby disposed along a direction normal to substantially the vehicle body up-down direction (a direction diagonally upward toward the vehicle rear in side view).

A front end portion and a rear end portion of the upright panel 32 are respectively formed with recessed portions 32A, 32B that are each recessed in a substantially rectangular shape toward the vehicle width direction inside. The recessed portion 32A at the front end portion of the upright panel 32 is attached by welding to an outside wall 26A at the rear side intermediate portion of the curved section 26, and the recessed portion 32B at the rear end portion of the upright panel 32 is attached by welding to an outside wall 24A of the rear side attachment section 24.

Namely, in respective side views, in both the right side luggage door hinge 20R illustrated in FIG. 2 and the left side luggage door hinge 20L illustrated in FIG. 3, the coupling member 30 is attached such that a substantially triangular shape is formed by the rear side intermediate portion of the curved section 26, the rear side attachment section 24, and the coupling member 30. Configuration is thereby such that a bent portion 25, which is a boundary portion between the curved section 26 and the rear side attachment section 24, is reinforced, and the rigidity of the rear side attachment section 24, to which the luggage door 12 is fastened and fixed, is improved. The coupling member 30 may therefore be considered to be a reinforcing member of the bent portion 25.

A coil spring 18, with one end portion attached to the front side intermediate portion of the curved section 26 of the luggage door hinge 20, and another end portion attached to the vehicle body 10, is disposed at the vehicle width direction outside of the luggage door hinge 20. Configuration is such that the coil spring 18 biases the luggage door hinge 20 toward an open direction of the luggage door 12 (the arrow E direction illustrated in the drawings), and the luggage door 12 is lifted slightly upward due to the biasing force of the coil spring 18 when a lock (not illustrated in the drawings) of the luggage door 12 is released.

Explanation follows regarding operation of the luggage door hinge 20 configured as described above.

Figure 6:
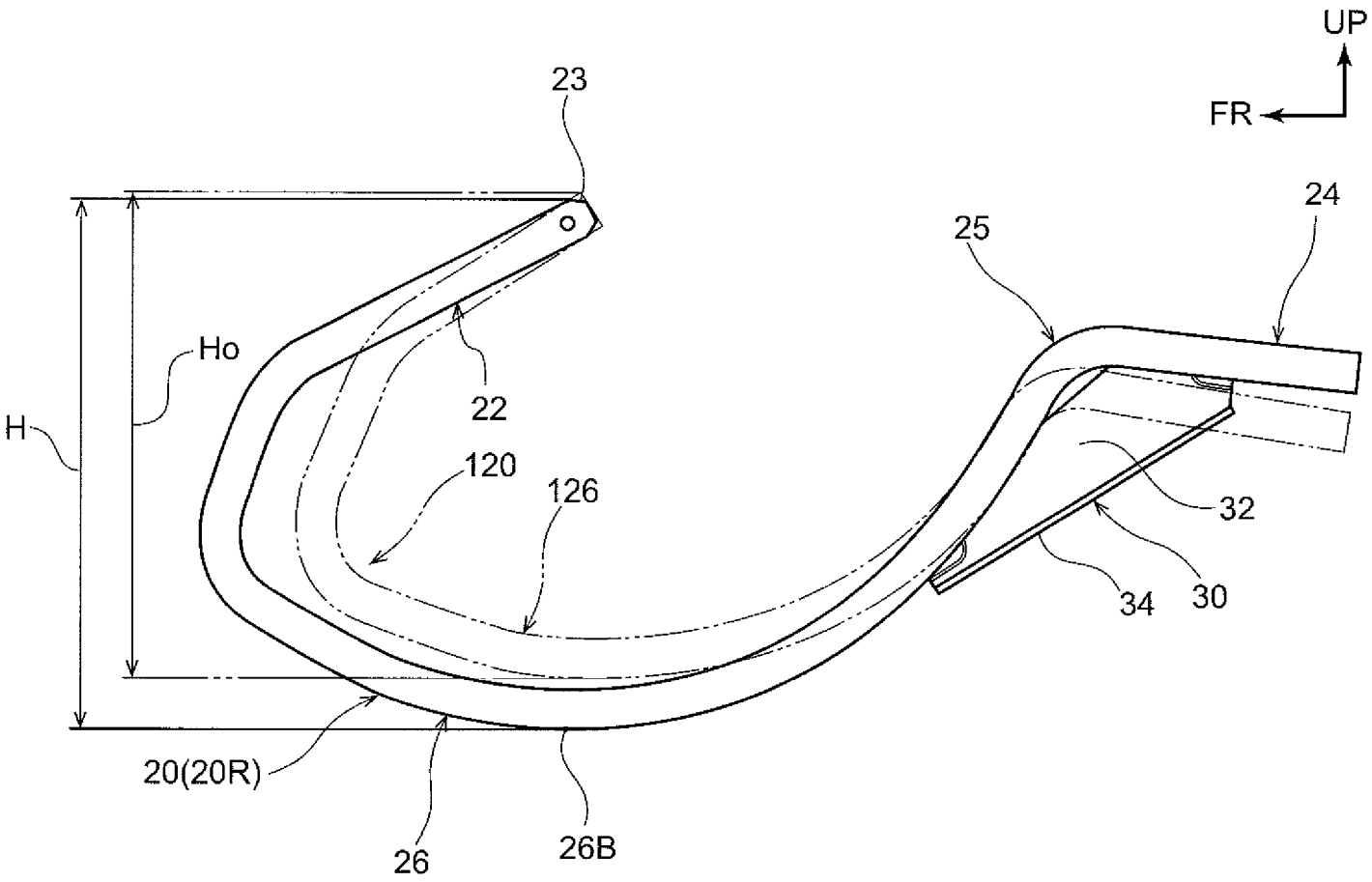
FIG. 6 is an explanatory drawing illustrating a right side luggage door hinge according to the exemplary embodiment and a luggage door hinge according to a comparative example superimposed on each other.

As described above, enlarging the shape of the curved section 26 of the luggage door hinge 20 to reduce rigidity is effective in lowering the resonance frequency of the luggage door 12. Thus, as illustrated in FIG. 6, the shape of the curved section 26 of the luggage door hinge 20 according to the present exemplary embodiment is larger than the shape of a curved section 126 of a luggage door hinge 120 of a comparative example, this being a conventional luggage door hinge.

Specifically, in side view, the curved section 26 of the luggage door hinge 20 according to the present exemplary embodiment is enlarged so as to jut out further toward the vehicle body lower front side than the curved section 126 of the luggage door hinge 120 according to the comparative example. The rigidity of the luggage door hinge 20 is reduced when the curved section 26 of the luggage door hinge 20 is enlarged so as to jut out toward the vehicle body lower front side, such that the fitting rigidity of the luggage door 12 by the luggage door hinge 20 is thereby reduced.

However, in the luggage door hinge 20 according to the present exemplary embodiment, the rear side intermediate portion of the curved section 26 and the rear side attachment section 24 are coupled together by the coupling member 30, reinforcing the bent portion 25, which is the boundary portion between the curved section 26 and the rear side attachment section 24 that largely contributes to the fitting rigidity of the luggage door 12. This enables the rigidity of the rear side attachment section 24 to which the luggage door 12 is fastened and fixed to be improved, and enables a reduction in the fitting rigidity (fitting performance) of the luggage door 12 to be suppressed.

Namely, the luggage door hinge 20 according to the present exemplary embodiment enables the resonance frequency of the luggage door 12 to be lowered, while suppressing a reduction in the fitting rigidity (fitting performance) of the luggage door 12. Thus configuration can be made in automatic vehicles such that the resonance frequency of the engine during lock-up and the resonance frequency of the luggage door 12 do not match, enabling noise occurring during lock-up (vehicle interior noise) to be reduced.

The coupling member 30 of the luggage door hinge 20 according to the present exemplary embodiment includes the upright panel 32 and the lateral panel 34 that are orthogonal to each other, such that the cross-section profile thereof forms an "L" shape. This enables the rigidity of the coupling member 30 to be improved, compared to a coupling member (not illustrated in the drawings) with a cross-section profile that is not formed in an "L" shape. This enables the rigidity of the rear side attachment section 24 of the luggage door hinge 20 to be more effectively improved, and enables a reduction in the fitting rigidity (fitting performance) of the luggage door 12 to be more effectively suppressed.

In the luggage door hinge 20 according to the present exemplary embodiment, the curved section 26 is enlarged so as to jut out further to the vehicle body lower front side than the curved section 126 of the luggage door hinge 120 according to the comparative example, and is larger in size overall. However, in the luggage door hinge 20 according to the present exemplary embodiment, the beveled portion 23 is formed at the upper portion side of the front side attachment section 22, such that the height H is thereby suppressed from becoming higher.

Note that dimension specifications (mounting requirements) when attaching the luggage door hinge 20 inside the luggage room 14 stipulate that a length D in the vehicle body front-rear direction of the open edge portion 14A of the luggage room 14 at a location where the luggage door hinge 20 is disposed is larger than the height H of the luggage door hinge 20 in the closed state of the luggage door 12+10 mm (D>H+10 mm), The open edge portion 14A of the luggage room 14 is configured such that the length D in the vehicle body front-rear direction increases on progression from the vehicle width direction outsides toward the vehicle width direction inside. Thus, when the height H of the luggage door hinge 20 increases, there is a concern that an attachment position of the luggage door hinge 20 needs to be shifted toward the vehicle width direction inside, and that the capacity of the luggage room 14 is reduced by the luggage door hinge 20.

However, in the luggage door hinge 20 according to the present exemplary embodiment, the height H is suppressed from becoming higher than a height Ho of the luggage door hinge 120 according to the comparative example by the beveled portion 23 formed to the upper portion side of the front side attachment section 22. This enables the luggage door hinge 20 according to the present exemplary embodiment to be suppressed from being disposed further toward the vehicle width direction inside than the luggage door hinge 120 according to the comparative example.

Namely, in the luggage door hinge 20 according to the present exemplary embodiment, even though the shape of the curved section 26 is larger than the shape of the curved section 126 of the luggage door hinge 120 according to the comparative example, the capacity of the luggage room 14 (the distance between the right side luggage door hinge 20R and the left side luggage door hinge 20L) can be suppressed from being less than hitherto.

Note that, when the height H of the luggage door hinge 20 can be further lowered by increasing the size of the beveled portion 23, the luggage door hinge 20 inside the luggage room 14 can be disposed as far as possible toward the vehicle width direction outside. This enables a reduction in the capacity of the luggage room 14 to be further suppressed.

The luggage door hinge 20 according to the present exemplary embodiment has been explained above based on the drawings; however, the luggage door hinge 20 according to the present exemplary embodiment is not limited to that illustrated in the drawings, and the design may be modified. For example, the coupling member 30 is not limited to being configured by the upright panel 32 and the lateral panel 34, and may be configured by a biasing spring or the like (not illustrated in the drawings) that biases the rear side intermediate portion of the curved section 26 and the rear side attachment section 24 in separate directions to each other (that is, away from each other).

What is claimed is:

1. A luggage door hinge comprising:

a front side attachment section that is configured to be rotatably supported by a vehicle body;

a rear side attachment section that extends along a vehicle body front-rear direction in a closed state of a luggage door that opens and closes a luggage room, and that is configured to be fixed to the luggage door;

a curved section that curves in a substantially circular arc shape between the front side attachment section and the rear side attachment section, toward a vehicle body lower side in the closed state of the luggage door;

a coupling member that couples together an intermediate portion of the curved section and the rear side attachment section; and a bent portion between the curved section and the rear side attachment section, the bent portion curving toward a vehicle body upper side in a direction opposite to a direction in which the curved section curves, wherein a front end of the coupling member is attached to the intermediate portion of the curved section at a first location forward of the bent portion, and a rear end of the coupling member is attached to the rear side attachment section at a second location rearward of the bent portion.

2. The luggage door hinge of claim 1, wherein an upper portion side of the front side attachment section includes a beveled portion that forms a horizontal face in the closed state of the luggage door.

3. The luggage door hinge of claim 1, wherein the coupling member comprises an upright panel and a lateral panel that are orthogonal to each other so that the coupling member has an L shaped cross-section profile.

4. The luggage door hinge of claim 1, wherein the rear side attachment section includes a plurality of attachment points at which the rear side attachment section is attached to the luggage door, and a rear end of the coupling member is attached to the rear side attachment section at a location between two of the plurality of attachment points of the rear side attachment section.

5. The luggage door hinge of claim 1, wherein the bent portion and the coupling member form a triangle.

6. A luggage door hinge comprising:

a front section having a rotatable connection by which to rotatably attach the luggage door hinge to a vehicle body;

a rear section having a connection by which to fix the luggage door hinge to a luggage door, the rear section extending along a vehicle body front-rear direction in a closed state of the luggage door that opens and closes a luggage room;

a curved section having an arc shape, the curved section extending between the front section and the rear section, the curved section protruding toward a vehicle body lower side in the closed state of the luggage door;

a reinforcing coupling having a first end fixed to an intermediate portion of the curved section and a second end fixed to the rear section; and a bent portion between the curved section and the rear section, the bent portion protruding toward a vehicle body upper side and curving in a direction opposite to a direction in which the curved section curves, wherein the first end of the reinforcing coupling is attached to the intermediate portion of the curved section at a first location forward of the bent portion, and the second end of the reinforcing coupling is attached to the rear section at a second location rearward of the bent portion.

7. The luggage door hinge of claim 6, wherein an upper portion of the front section includes a beveled portion that forms a horizontal face in the closed state of the luggage door.

8. The luggage door hinge of claim 6, wherein the reinforcing coupling comprises an upright panel and a lateral panel that are orthogonal to each other so that the reinforcing coupling has an L shaped cross-section profile.

9. The luggage door hinge of claim 6, wherein the reinforcing coupling comprises a first panel and a second panel that are orthogonal to each other so that the reinforcing coupling has an L shaped cross-section profile.

10. The luggage door hinge of claim 6, wherein the reinforcing coupling comprises a first panel and a second panel that are attached to each other and extend in different planes.

11. The luggage door hinge of claim 6, wherein the rotatable connection includes a hole in the front section.

12. The luggage door hinge of claim 6, wherein the connection of the rear section includes a plurality of holes in the rear section that are configured to receive bolts.

13. The luggage door hinge of claim 12, wherein the second end of the reinforcing coupling is attached to the rear section at a location between two of the plurality of holes of the rear section.

14. The luggage door hinge of claim 6, wherein the rear section includes a plurality of attachment points at which the rear section is attached to the luggage door, and the second end of the reinforcing coupling is attached to the rear section at a location between two of the plurality of attachment points of the rear section.

15. The luggage door hinge of claim 6, wherein the bent portion and the reinforcing coupling form a triangle.

* * * * *